US010960672B2

(12) United States Patent
Yamada

(10) Patent No.: US 10,960,672 B2
(45) Date of Patent: Mar. 30, 2021

(54) INK JET PRINTER

(71) Applicant: Roland DG Corporation, Hamamatsu (JP)

(72) Inventor: Ryota Yamada, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/741,797

(22) Filed: Jan. 14, 2020

(65) Prior Publication Data

US 2020/0230954 A1 Jul. 23, 2020

(51) Int. Cl.
*B41J 2/045* (2006.01)
*B41J 2/165* (2006.01)

(52) U.S. Cl.
CPC ..... *B41J 2/16517* (2013.01); *B41J 2/04536* (2013.01); *B41J 2/04573* (2013.01); *B41J 2/04586* (2013.01); *B41J 2/1652* (2013.01); *B41J 2/16505* (2013.01); *B41J 2/16523* (2013.01); *B41J 2/16532* (2013.01); *B41J 2/16535* (2013.01); *B41J 2002/16573* (2013.01)

(58) Field of Classification Search
CPC ..... B41J 2/04536; B41J 2/04573; B41J 2/16517; B41J 2/1652; B41J 2/16523; B41J 2/16526; B41J 2/16532; B41J 2/16535; B41J 2002/16573
See application file for complete search history.

(56) References Cited

U.S. PATENT DOCUMENTS

2002/0035445 A1* 3/2002 Kimura ..... B41J 2/16517 702/177
2007/0216720 A1* 9/2007 Akase ..... B41J 2/165 347/22

FOREIGN PATENT DOCUMENTS

JP 11-129487 A 5/1999
JP 11129487 A * 5/1999

* cited by examiner

*Primary Examiner* — Matthew Luu
*Assistant Examiner* — Kendrick X Liu

(57) ABSTRACT

A printer includes a main power supply switch to drive a controller, and a sub-power supply switch to enable printing on a recording medium. The controller includes a memory that stores a turn-on frequency of turning on of the sub-power supply per a unit time in a predetermined period of a predetermined first duration, a calculator that calculates a sum of the turn-on frequency in a predetermined second duration for each of predetermined second durations starting at different start times, in the predetermined period, a specifier that specifies, as a specified start time, a start time of the predetermined second duration for which the sum calculated by the calculator is at a maximum, and a cleaner that performs a cleaning operation of discharging ink from at least the nozzles at the specified start time.

6 Claims, 9 Drawing Sheets

INK JET PRINTER

CROSS REFERENCE TO RELATED APPLICATIONS

This application claims the benefit of priority to Japanese Patent Application No. 2019-6945 filed on Jan. 18, 2019. The entire contents of this application are hereby incorporated herein by reference.

BACKGROUND OF THE INVENTION

1. Field of the Invention

The present disclosure relates to an ink jet printer.

2. Description of the Related Art

An ink jet printer known to date includes an ink head including a plurality of nozzles and a nozzle surface on which the nozzles are formed, and performs predetermined printing on a recording medium in an ink jet manner. In such an ink jet printer, when a predetermined time has elapsed from the end of printing, ink in nozzles increases in viscosity or solidifies. When ink in this state is discharged from the nozzles for printing, the quality of printed objects degrades. To discharge ink from the nozzles appropriately during printing, if a predetermined time has elapsed before the start of printing, the ink jet printer performs a cleaning operation of discharging ink in the nozzles beforehand.

JP H11-129487A, for example, discloses an ink jet recorder that performs a cleaning operation while a user does not use the ink jet recorder based on a printing history.

In a typical ink jet printer, if a predetermined time has elapsed from the previous cleaning operation when printing starts upon turning on of a power supply, the ink jet printer forcibly performs a cleaning operation in order to discharge ink from nozzles appropriately. Thus, in most cases, the cleaning operation is performed at the time when a user turns the power supply on. This disadvantageously interrupts work by the user.

SUMMARY OF THE INVENTION

Preferred embodiments of the present invention provide ink jet printers each capable of discharging ink from nozzles appropriately without a cleaning operation being performed at a time when printing starts by turning a power supply on.

An ink jet printer according to a preferred embodiment of the present disclosure includes an ink head including a plurality of nozzles from which ink is discharged onto a recording medium and a nozzle surface in which the plurality of nozzles are provided, a controller that controls discharge of ink from the plurality of nozzles, a main power supply that drives the controller, and a sub-power supply that enables printing on the recording medium by the ink head. The controller includes a memory that stores a turn-on frequency of turning on of the sub-power supply per a unit time in a predetermined period of a predetermined first duration, a calculator that calculates a sum of the turn-on frequency in a predetermined second duration for each of a plurality of predetermined second durations starting at different start times in the predetermined period, a specifier that specifies, as a specified start time, a start time of the predetermined second duration for which the sum calculated by the calculator is at maximum, and a cleaner that performs a cleaning operation of discharging ink from at least the plurality of nozzles at the specified start time specified by the specifier.

In an ink jet printer according to a preferred embodiment of the present disclosure, the calculator calculates a sum of turn-on frequencies of the sub-power supply for each of a plurality of predetermined second durations starting at different start times. The specifier specifies, as a specified start time, the start time of the predetermined second duration for which the sum is at maximum. In a case where the predetermined second duration or more, for example, has elapsed from the previous cleaning operation after the sub-power supply is turned off, the cleaning operation needs to be performed before printing. The specifier can specify the most efficient timing for performing the cleaning operation. The cleaner performs the cleaning operation at the specified start time specified by the specifier. Accordingly, the cleaning operation has been already completed before a user turns the sub-power supply on, and the possibility of performing no cleaning operation after turning on of the sub-power supply switch and before start of printing is the highest. That is, the cleaning operation is completed prior to a time zone in which the possibility that the sub-power supply is turned on by the user is high. Accordingly, the cleaning operation is likely to have been performed when the user starts printing by turning the sub-power supply switch on. Consequently, interruption of work by the user is reduced.

Preferred embodiments of the present disclosure provide ink jet printers each capable of appropriately discharging ink from nozzles without a cleaning operation being performed when a sub-power supply is turned on for starting printing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
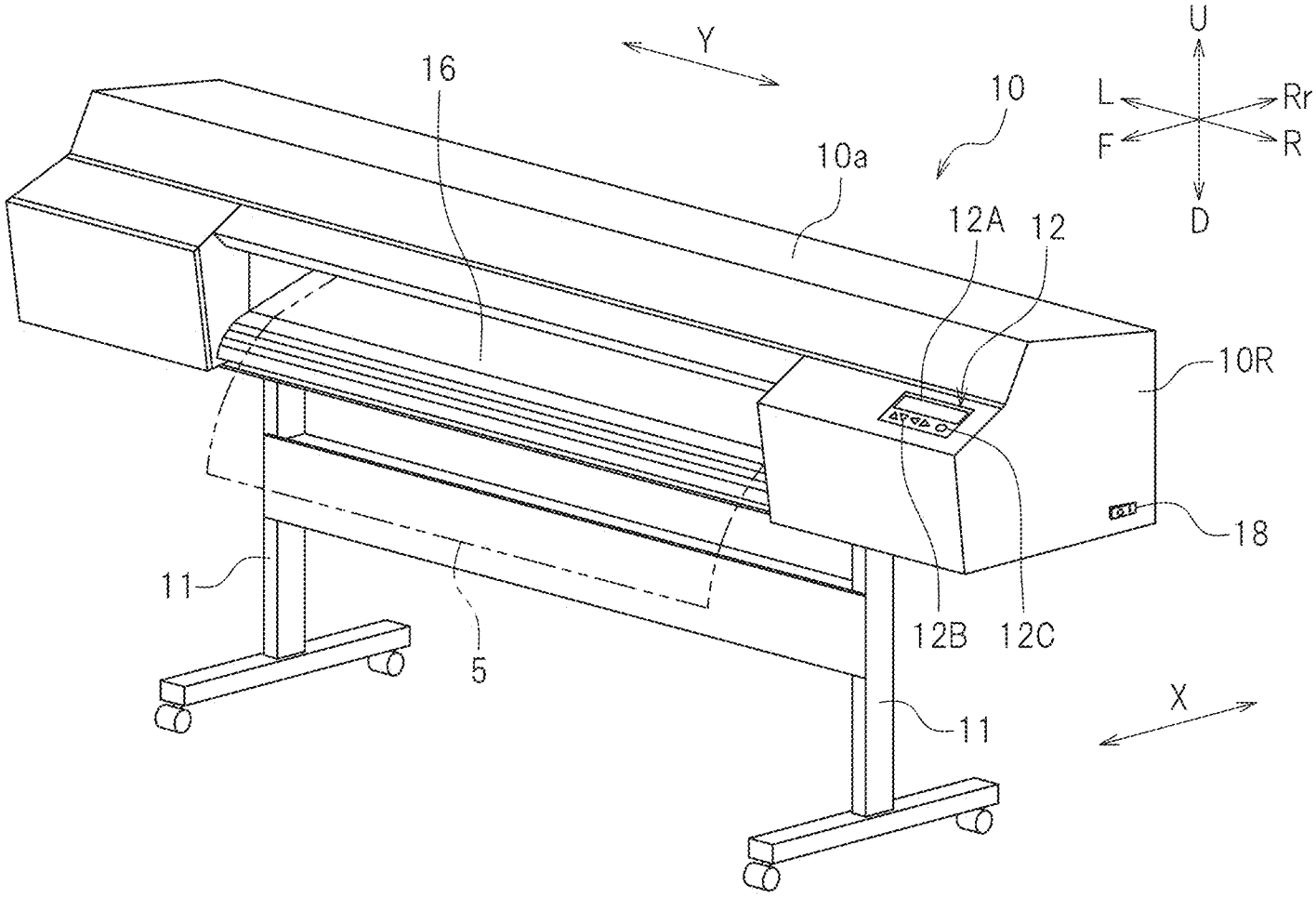
FIG. 1 is a perspective view of a printer according to a preferred embodiment of the present invention.

Ink jet printers (hereinafter referred to as a "printer" or "printers") according to preferred embodiments of the present disclosure will be described hereinafter with reference to the drawings. The preferred embodiments described herein are, of course, not intended to particularly limit the present disclosure. Elements and features having the same functions are denoted by the same reference numerals, and description for the same members and elements will not be repeated or will be simplified as appropriate.

FIG. 1 is a perspective view of a printer 10 according to a present preferred embodiment. In the following description, when a user sees the printer from the front, a direction away from the printer 10 will be referred to as forward, and a direction toward the printer 10 will be referred to as rearward. Left, right, up, and down respectively refer to left, right, up, and down when the printer 10 is seen from the front. Characters F, Rr, L, R, U, and D in the drawings represent front, rear, left, right, up, and down, respectively. Character Y represents main scanning directions in the drawings. In this preferred embodiment, the main scanning directions Y are left-right directions. Character X represents sub-scanning directions. In this preferred embodiment, the sub-scanning directions X are front-rear directions, and are orthogonal to the main scanning directions Y in plan view. It should be noted that the directions described above are defined simply for convenience of description, and are not intended to limit the state of installation of the printer 10 and do not limit the present disclosure.

The printer 10 preferably is an ink jet printer, for example. The printer 10 is elongated along the main scanning directions Y as compared to household printers, and preferably is a so-called large-size printer. For example, the printer 10 is a business-use printer. In this preferred embodiment, the printer 10 sequentially moves roll-shaped recording media 5 forward, and causes ink heads 40A, 40B, and 40C (see FIG. 2) mounted on a carriage 30 (see FIG. 2) configured to move in the main scanning directions Y to discharge ink for image formation (e.g., process color ink or white ink), thus printing images on the recording media 5.

The recording media 5 are, for example, recording sheets. The recording media 5 are not limited to the recording sheets. The recording media 5 may be other media such as resin sheets or films of, for example, polyvinyl chloride or polyester or fabrics such as a woven fabric or nonwoven fabrics, as well as paper sheets such as plain paper or ink jet printing paper.

Figure 2:
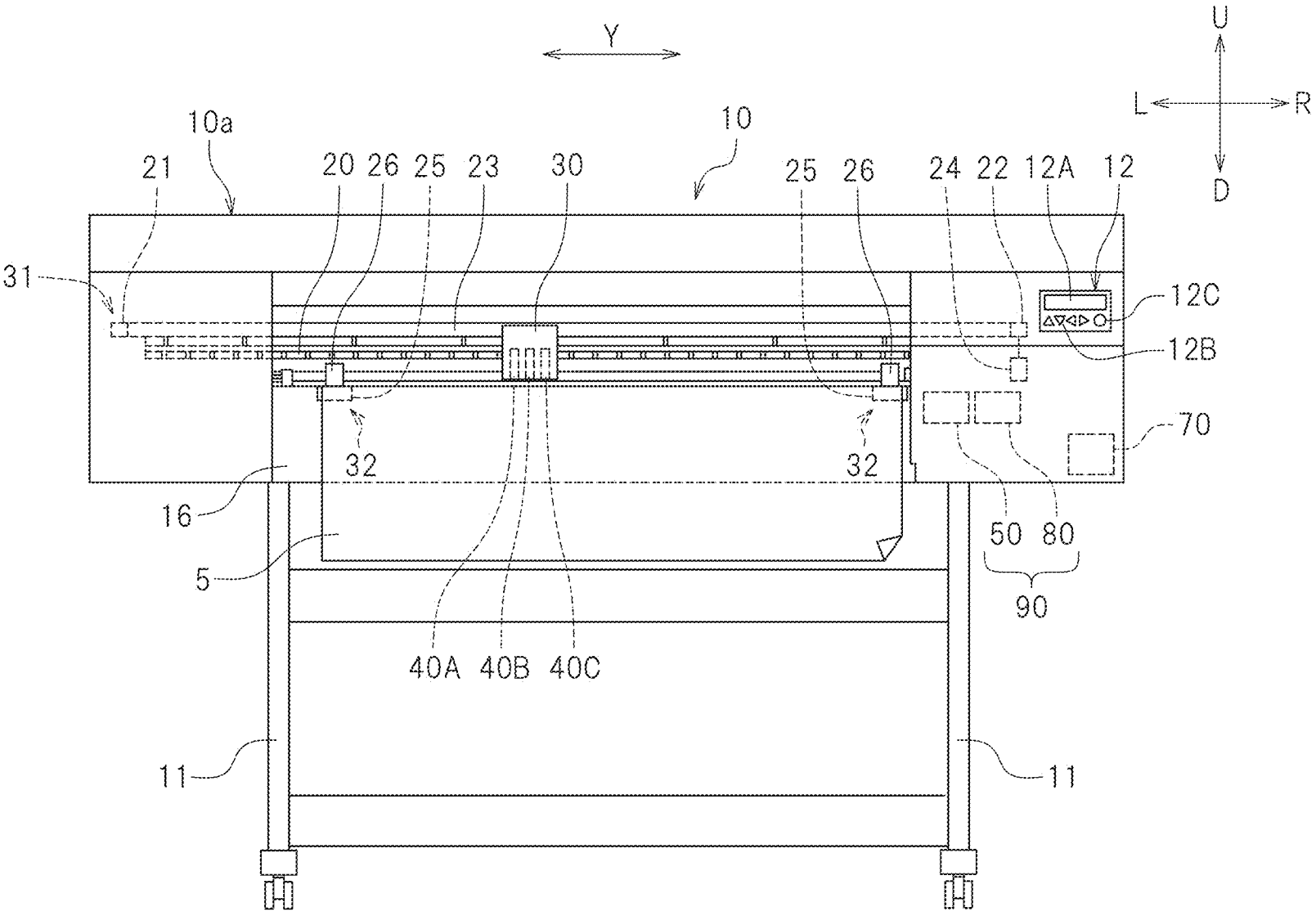
FIG. 2 is a front view of a printer according to a preferred embodiment of the present invention.

As illustrated in FIG. 1, the printer 10 includes a printer body 10*a*, legs 11, an operation panel 12, a platen 16, a controller 70 (see FIG. 2), and a maintenance device 90 (see FIG. 2). The printer body 10*a* includes a casing extending along the main scanning directions Y. The legs 11 support the printer body 10*a* and are disposed on the lower surface of the printer body 10*a*.

The platen 16 supports the recording media 5 during printing on the recording media 5. The recording media 5 are placed on the platen 16. Printing on the recording media 5 is performed on the platen 16. The platen 16 extends along the main scanning directions Y.

As illustrated in FIG. 2, the printer 10 includes the carriage 30 and a head mover 31. The head mover 31 moves the carriage 30 in the main scanning directions Y relative to the recording media 5 placed on the platen 16. The head mover 31 is not limited to a specific configuration. The head mover 31 includes a guide rail 20, a pulley 21, a pulley 22, an endless belt 23, and a carriage motor 24. The guide rail 20 guides movement of the carriage 30 in the main scanning directions Y. The guide rail 20 is disposed above the platen 16. The guide rail 20 extends in the main scanning directions Y. The pulley 21 is disposed at the left end of the guide rail 20. The pulley 22 is disposed at the right end of the guide rail 20. The belt 23 is wound around the pulley 21 and the pulley 22. The carriage motor 24 is connected to the right pulley 22. The carriage motor 24 may be connected to the left pulley 21. In this preferred embodiment, when the carriage motor 24 is driven and the pulley 22 rotates, the belt 23 runs between the pulley 21 and the pulley 22.

As illustrated in FIG. 2, the carriage 30 is attached to the belt 23. The carriage 30 is engaged with the guide rail 20 and slidably disposed on the guide rail 20. The carriage 30 carries the ink heads 40A, 40B, and 40C. With driving of the carriage motor 24, the belt 23 runs and the carriage 30 moves in the main scanning directions Y. Accordingly, the ink heads 40A, 40B, and 40C mounted on the carriage 30 move in the main scanning directions Y.

As illustrated in FIG. 2, the printer 10 includes a medium transport mechanism 32. The medium transport mechanism 32 moves the recording media 5 placed on the platen 16 relative to the carriage 30 in the sub-scanning directions X. In this preferred embodiment, the medium transport mechanism 32 moves the recording media 5 placed on the platen 16 in the sub-scanning directions X (see FIG. 1). The medium transport mechanism 32 is not limited to a specific configuration. The medium transport mechanism 32 includes grit rollers 25, pinching rollers 26, and a feed motor 27 (see FIG. 4). The grit rollers 25 are disposed on the platen 16. In this preferred embodiment, the grit rollers 25 are partially embedded in the platen 16. The pinching rollers 26 press the recording media 5 from above. The pinching rollers 26 are disposed above the grit rollers 25 to face the grit rollers 25 from above. The pinching rollers 26 may be movable upward and downward in accordance with the thickness of the recording media 5. The location and the number of the grit rollers 25 and the location and the number of the pinching rollers 26 are not specifically limited. In this preferred embodiment, the grit rollers 25 are disposed at the left end and the right end of the platen 16, and the pinching rollers 26 are also disposed at the left end and the right end of the platen 16. The feed motor 27 is connected to the grit rollers 25. When the feed motor 27 is driven and the grit rollers 25 rotate, the recording media 5 are conveyed in one of the sub-scanning directions X with the recording media 5 sandwiched between the grit rollers 25 and the pinching rollers 26.

Figure 3:
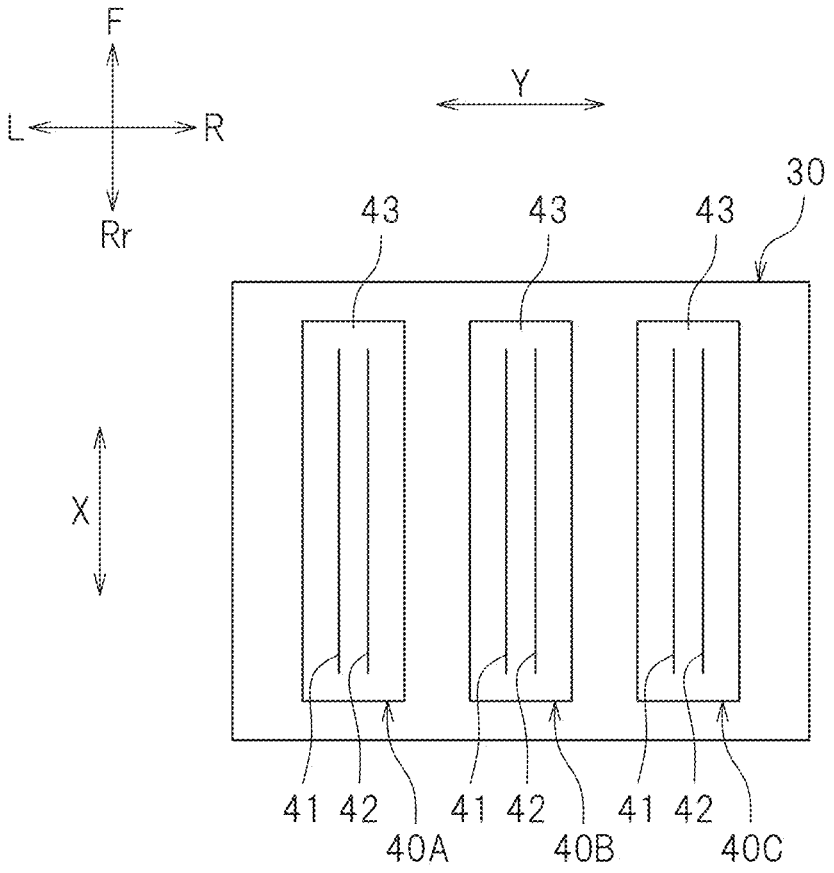
FIG. 3 is a bottom view of a carriage according to a preferred embodiment of the present invention.

As illustrated in FIG. 3, each of the ink heads 40A, 40B, and 40C is longer in the sub-scanning directions X (front-rear directions) than in the main scanning directions Y (left-right directions). The ink heads 40A, 40B, and 40C have the same shape and the same size. Each of the ink heads 40A, 40B, and 40C includes a plurality of first nozzles 41 arranged along the sub-scanning directions X, a plurality of second nozzles 42 arranged along the sub-scanning directions X, and a nozzle surface 43 in which the first nozzles 41 and the second nozzles 42 are provided. The inside of each of the first nozzles 41 and the second nozzles 42 is set at a negative pressure (pressure lower than the atmospheric pressure). Since the first nozzles 41 and the second nozzles 42 are minute, the plurality of first nozzles 41 and the plurality of second nozzles 42 are represented as lines in FIG. 3. In this preferred embodiment, for example, ink for image formation (e.g., cyan ink, magenta ink, yellow ink, black ink, white ink, or etc.) is discharged from the first nozzles 41 and the second nozzles 42 of the ink heads 40A, 40B, and 40C. In this preferred embodiment, each of the ink heads 40A, 40B, and 40C includes two types of nozzles: the first nozzles 41 and the second nozzles 42, but may include three or more types of nozzles. The ink heads 40A, 40B, and 40C are housed in the carriage 30 such that the nozzle surfaces 43 are exposed to the outside.

As illustrated in FIG. 2, the maintenance device 90 includes a wiping device 50 and a capping device 80. The maintenance device 90 is disposed inside the printer body 10*a*. The maintenance device 90 is disposed at the right of the platen 16. The wiping device 50 is disposed at the left of the capping device 80.

Figure 4:
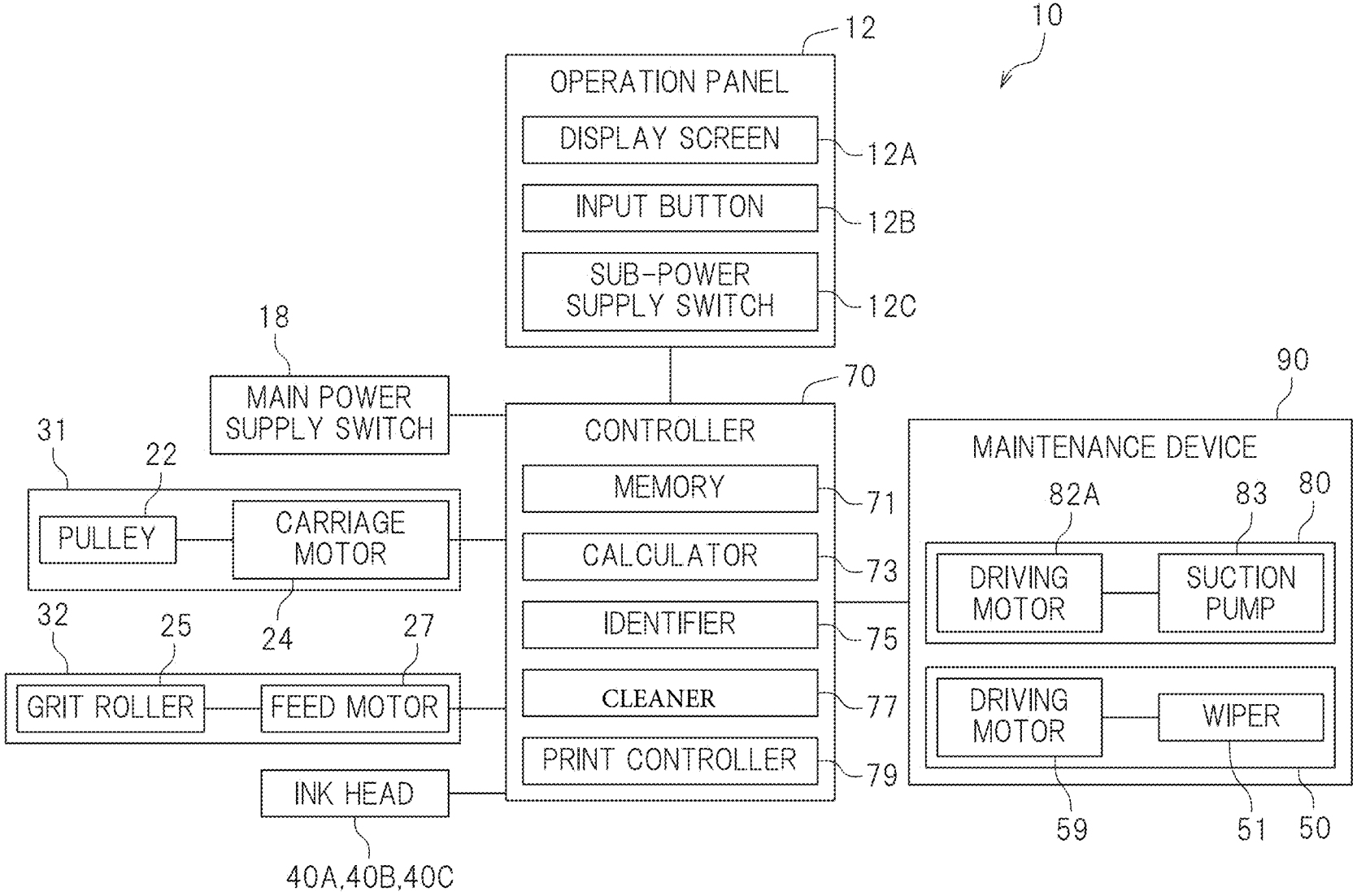
FIG. 4 is a block diagram of a printer according to a preferred embodiment of the present invention.
Figure 5:
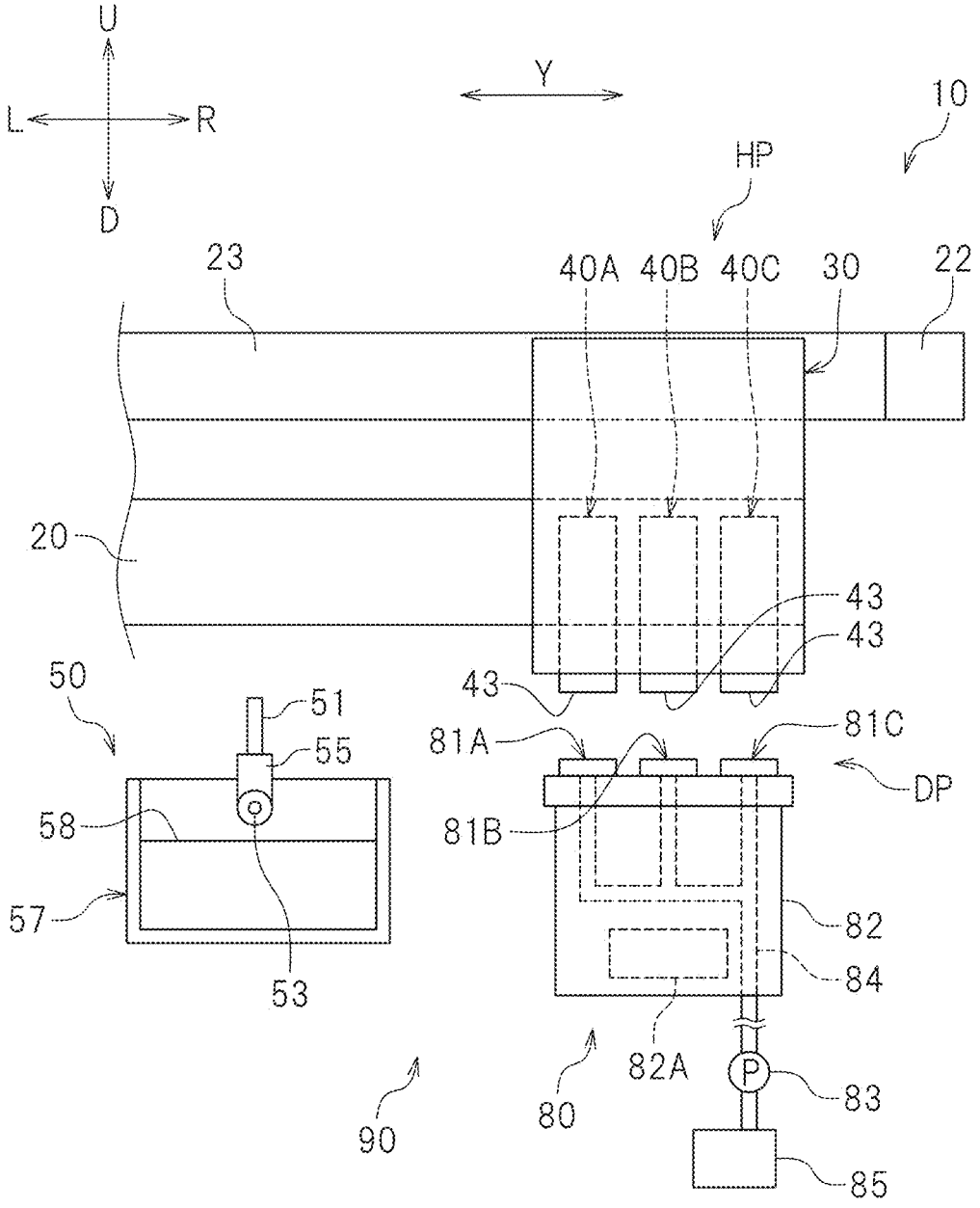
FIG. 5 illustrates a peripheral configuration of a maintenance device according to a preferred embodiment of the present invention, and is a front view showing a state where caps are detached from an ink head.

As illustrated in FIG. 5, the wiping device 50 includes a wiper 51, a spindle 53, a holder 55, a cleaning solution tank 57, and a driving motor 59 (see FIG. 4). The wiper 51 performs a wiping operation of wiping the nozzle surfaces 43 of the ink heads 40A, 40B, and 40C. Wiping is an example of the cleaning operation. The wiper 51 extends along the sub-scanning directions X. The length of the wiper 51 in the sub-scanning directions X is larger than the length of each of the first nozzles 41 and the second nozzles 42 in the sub-scanning directions X. The wiper 51 is disposed below the guide rail 20. The wiper 51 is positioned to contact the nozzle surfaces 43 when the carriage 30 passes above the wiper 51. The wiper 51 is plate-shaped and is made of, for example, rubber. The wiper 51 is pivotably supported by the spindle 53 disposed in the cleaning solution tank 57 with the holder 55 interposed therebetween. The wiper 51 is exchangeably attached to the holder 55. When the driving motor 59 is driven, the wiper 51 is caused to pivot about the spindle 53. The cleaning solution tank 57 stores a cleaning solution 58. The cleaning solution tank 57 supplies the wiper 51 with the cleaning solution 58. The cleaning solution 58 is used to clean the wiper 51. The cleaning solution 58 is not limited to a specific type. As the cleaning solution 58, water or an organic solvent, for example, can be appropriately used depending on the type of ink.

As illustrated in FIG. 5, the capping device 80 includes a first cap 81A, a second cap 81B, a third cap 81C, a cap mover 82, and a suction pump 83. The first cap 81A, the second cap 81B, the third cap 81C, and the cap mover 82 are located at a home position HP at the right end of the guide rail 20. In this preferred embodiment, the home position HP refers to a position at which the carriage 30 and the ink heads 40A, 40B, and 40C are kept on standby at a printing standby mode, that is, while no printing is performed. The home position HP is not limited to a specific position, and may be at the left end of the guide rail 20. In this preferred embodiment, as illustrated in FIG. 2, the capping device 80 is disposed at the right of the platen 16.

The first cap 81A, the second cap 81B, and the third cap 81C suppress or prevent clogging of the first nozzles 41 and the second nozzles 42 of the ink heads 40A, 40B, and 40C (see FIG. 3), respectively, because of hardening of ink attached to the first nozzles 41 and the second nozzles 42. In the printing standby mode, the first cap 81A, the second cap 81B, and the third cap 81C are respectively attached to the ink heads 40A, 40B, and 40C and cover the nozzle surfaces 43. Specifically, as illustrated in FIG. 6, when the carriage 30 moves to the home position HP, the first cap 81A, the second cap 81B, and the third cap 81C are respectively attached to the ink heads 40A, 40B, and 40C.

The cap mover 82 supports the first cap 81A, the second cap 81B, and the third cap 81C. The cap mover 82 moves the first cap 81A, the second cap 81B, and the third cap 81C such that the first cap 81A, the second cap 81B, and the third cap 81C can be detachably attached to the ink heads 40A, 40B, and 40C, respectively. In this preferred embodiment, the cap mover 82 moves the first cap 81A, the second cap 81B, and the third cap 81C upward and downward. The cap mover 82 is not limited to a specific configuration, and includes a driving motor 82A, for example. Driving of the driving motor 82A causes the cap mover 82 to move the first cap 81A, the second cap 81B, and the third cap 81C upward and downward. When the cap mover 82 moves the first cap 81A, the second cap 81B, and the third cap 81C upward, the first cap 81A, the second cap 81B, and the third cap 81C move to a cap position CP (see FIG. 6). In this preferred embodiment, the cap position CP refers to a position at which the first cap 81A, the second cap 81B, and the third cap 81C cover the nozzle surfaces 43 of the ink heads 40A, 40B, and 40C. Accordingly, the first cap 81A, the second cap 81B, and the third cap 81C are attached to the ink heads 40A, 40B, and 40C, respectively. Once the first cap 81A, the second cap 81B, and the third cap 81C are respectively attached to the ink heads 40A, 40B, and 40C, a hermetic space 48 (see FIG. 6) is provided between the nozzle surfaces 43 and each of the first cap 81A, the second cap 81B, and the third cap 81C. In performing a wiping operation or printing, the cap mover 82 moves the first cap 81A, the second cap 81B, and the third cap 81C downward so that the first cap 81A, the second cap 81B, and the third cap 81C move from the cap position CP (see FIG. 6) to a detached position DP (see FIG. 5). In this preferred embodiment, the detached position DP refers to a position at which the first cap 81A, the second cap 81B, and the third cap 81C are detached from the nozzle surfaces 43. Accordingly, the first cap 81A, the second cap 81B, and the third cap 81C are respectively detached from the ink heads 40A, 40B, and 40C.

Figure 6:
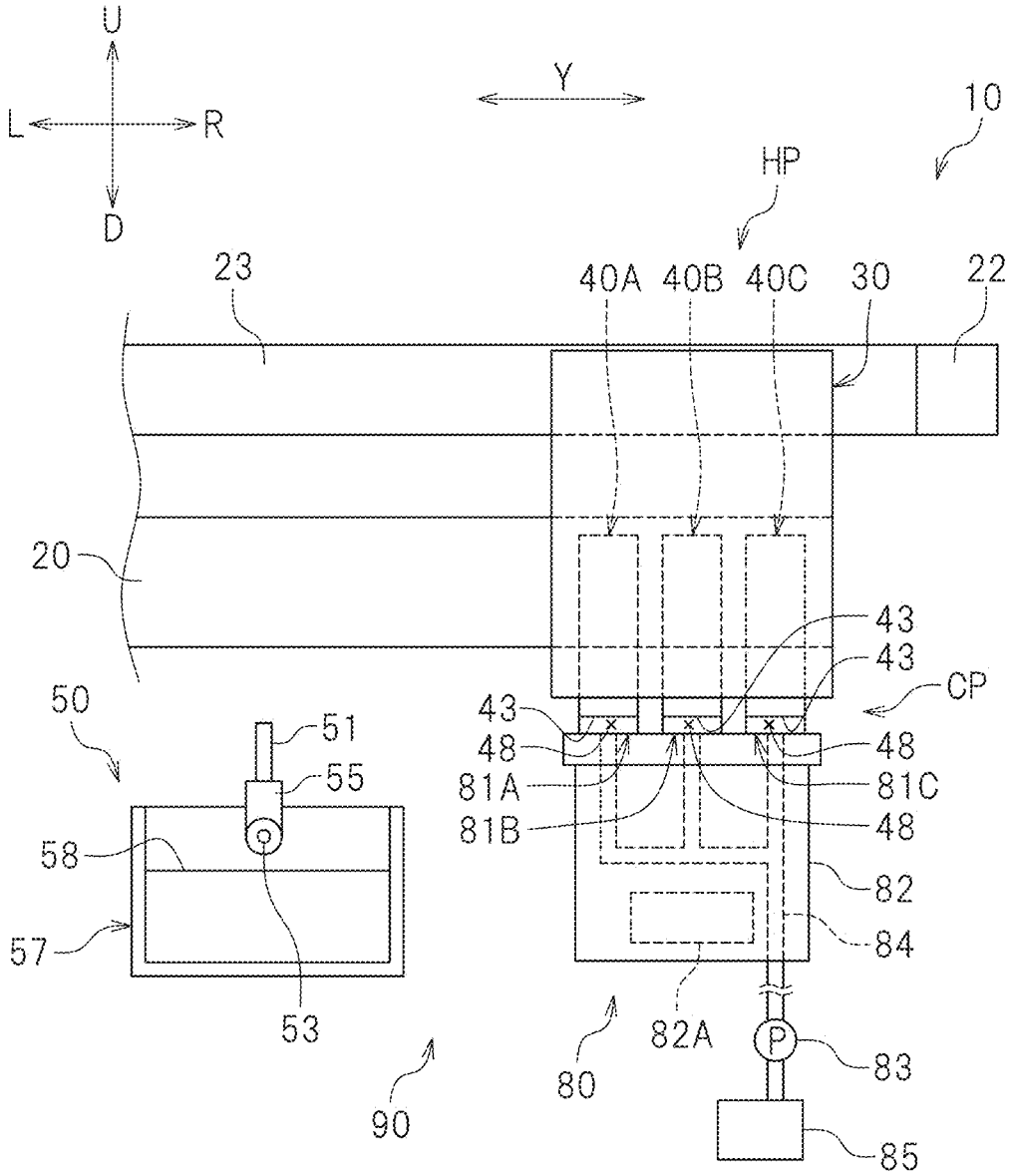
FIG. 6 illustrates a peripheral configuration of a maintenance device according to a preferred embodiment of the present invention, and is a front view showing a state where caps are attached to an ink head.

As illustrated in FIG. 6, in a state where the first cap 81A, the second cap 81B, and the third cap 81C are respectively attached to the ink heads 40A, 40B, and 40C, the suction pump 83 performs a suction operation of sucking fluid (e.g., ink for image formation) remaining in the hermetic space 48. The suction operation is an example of the cleaning operation. The suction operation sets the hermetic space 48 at a pressure lower than an atmospheric pressure. Consequently, the ink for image formation is forcibly emitted from the first nozzles 41 and the second nozzles 42 of the ink heads 40A, 40B, and 40C. A suction port of the suction pump 83 is connected to the first cap 81A, the second cap 81B, and the third cap 81C through a flexible tube 84. A discharge port of the suction pump 83 is connected to a waste liquid tank 85. Fluid in the hermetic space 48 sucked by the suction pump 83 is stored in the waste liquid tank 85. The suction operation is an operation for eliminating discharge failures of the first nozzles 41 and the second nozzles 42, and is an operation for preventing clogging of the first nozzles 41 and the second nozzles 42 of the ink heads 40A, 40B, and 40C.

As illustrated in FIG. 1, the printer 10 includes a main power supply switch 18. The main power supply switch 18 switches electric power to the printer 10 between on and off, that is, turns the printer 10 on and off. The main power supply switch 18 is an example of a main power supply. The main power supply switch 18 is disposed on a right wall 1OR of the printer body 10*a*. When the main power supply switch 18 is turned on, the power supply of the printer 10 is turned on. When the main power supply switch 18 is turned off, the power supply of the printer 10 is turned off. The main power supply switch 18 is used to drive the controller 70. In general, the main power supply switch 18 is also on while no printing is performed. The printer 10 is configured to switch to a sleep state (also referred to as, for example, a power standby mode) and to turn a sub-power supply switch 12C described later off for power saving or other purposes when the printer 10 is left for a certain period.

As illustrated in FIG. 1, the operation panel 12 is provided in the printer body 10*a*. The operation panel 12 is disposed on a right portion of the printer body 10*a*. The operation panel 12 is disposed at the right of the platen 16. The operation panel 12 is a panel with which a user performs a setting operation and an input operation concerning printing of an image. The operation panel 12 functions as a sub-power supply to an electric circuit board (not shown) enabling printing on recording media 5 with the ink heads 40A, 40B, and 40C. The operation panel 12 includes a display screen 12A that displays information on printing such as the type of printing, a resolution, a status of printing, and setting of a printing region, and an input button 12B to set information on printing, for example. The operation panel 12 includes the sub-power supply switch 12C. The sub-power supply switch 12C is an example of a sub-power supply. When the sub-power supply switch 12C is turned on, printing on recording media 5 can be performed. That is, by turning the sub-power supply switch 12C on, a printing instruction is issued to the printer 10. In a case where the printer 10 is in a sleep state, the sleep state of the printer 10 is canceled and restored to a normal state (i.e., a printable state) by pressing the input button 12B or the sub-power supply switch 12C of the operation panel 12. The case where the sub-power supply switch 12C is turned off includes a case where the printer 10 is left for a predetermined period and comes to be in a sleep state and a case where the printer 10 is further left for a predetermined period so that the sub-power supply switch 12C is turned off.

As illustrated in FIG. 4, the controller 70 controls printing on recording media 5 and a cleaning operation for the ink heads 40A, 40B, and 40C. The controller 70 is not limited to a specific configuration. The controller 70 is, for example, a microcomputer. A hardware configuration of the microcomputer is not specifically limited. The microcomputer may include, for example, an interface (I/F) that receives printing data and other data from external equipment such as a host computer, a central processing unit (CPU) that executes an instruction of a control program, a read only memory (ROM) that stores programs to be executed by the CPU, a random access memory (RAM) that is used as a working area where programs are developed, and a memory that stores the programs, the data, and so forth. As illustrated in FIG. 2, the controller 70 is disposed inside the printer body 10*a*. The controller 70 may not disposed inside the printer body 10*a*. For example, the controller 70 may be a computer disposed outside the printer body 10*a*. In this case, the controller 70 is communicably connected to the printer body 10*a* by wires or wirelessly.

As illustrated in shown in FIG. 4, the controller 70 is communicably connected to the operation panel 12, the main power supply switch 18, the carriage motor 24 of the head mover 31, the feed motor 27 of the medium transport mechanism 32, the ink heads 40A, 40B, and 40C, the driving motor 82A of the capping device 80, the suction pump 83, and the driving motor 59 of the wiping device 50. The controller 70 controls the carriage motor 24, the feed motor 27, the ink heads 40A, 40B, and 40C, the driving motor 82A, suction pump 83, and the driving motor 59.

As illustrated in FIG. 4, the controller 70 controls driving of the carriage motor 24 to control rotation of the pulley 22 and running of the belt 23 (see FIG. 2). Accordingly, the controller 70 controls movement of the ink heads 40A, 40B, and 40C in the main scanning directions Y. The controller 70 controls driving of the feed motor 27 to control rotation of the grit rollers 25. In this manner, movement the recording media 5 placed on the platen 16 in the sub-scanning directions X is controlled. The controller 70 controls the timings of discharge of ink for image formation from the ink heads 40A, 40B, and 40C and the amount of discharge of the ink, for example. The controller 70 controls the timing and suction power of suction by the suction pump 83. That is, the controller 70 controls discharge of ink from the first nozzles 41 and the second nozzles 42 of the ink heads 40A, 40B, and 40C. The controller 70 controls driving of the driving motor 82A to thereby control upward and downward movement of the caps 81A, 81B, and 81C. The controller 70 controls driving of the driving motor 59 to control pivot of the wiper 51. The controller 70 functions by turning the main power supply switch 18 (see FIG. 1) of the printer 10 on.

A illustrated in FIG. 4, the controller 70 includes a memory 71, a calculator 73, a specifier 75, a cleaner 77, and a print controller 79. The function of these elements of the controller 70 may be implemented by a program. This program may be read from a recording medium such as a CD or a DVD. This program may be downloaded through the Internet. The functions of the elements of the controller 70 may be implemented by, for example, processor(s) and/or circuit(s). Specific functions of these elements will be described later.

Figure 7:
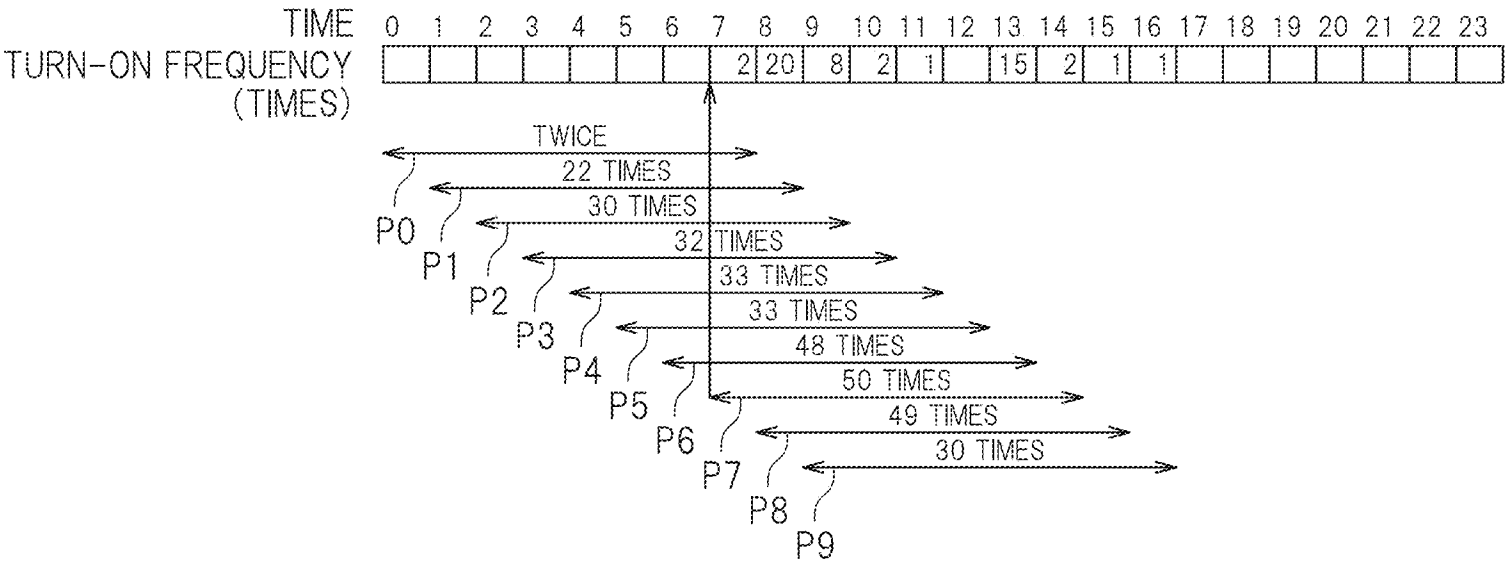
FIG. 7 is an example of a graph showing a frequency of turning on of a sub-power supply switch per a unit time.

The memory 71 stores a frequency of turning on of the sub-power supply switch 12C (turn-on frequency) per a unit time in a predetermined period of a predetermined first duration. In this preferred embodiment, the turn-on frequency of the sub-power supply switch 12C includes a frequency of turning on of the sub-power supply switch 12C from a state where the sub-power supply switch 12C is off and a frequency of canceling a sleep state by pressing the input button 12B while the sub-power supply switch 12C is on. The predetermined first duration is, for example, one week to three months. The predetermined period is, for example, 24 hours. The unit time is, for example, 10 minutes to one hour. FIG. 7 is a graph showing a turn-on frequency of the sub-power supply switch 12C per one hour in 24-hour period in a specific month. In the example shown in FIG. 7, the turn-on frequency of the sub-power supply switch 12C in a specific month is twice from 7 o'clock to 8 o'clock, 20 times from 8 o'clock to 9 o'clock, 8 times from 9 o'clock to 10 o'clock, twice from 10 o'clock to 11 o'clock, once from 11 o'clock to 12 o'clock, 15 times from 13 o'clock to 14 o'clock, twice from 14 o'clock to 15 o'clock, once from 15 o'clock to 16 o'clock, once from 16 o'clock to 17 o'clock, and zero at the other times.

The calculator 73 calculates a sum of turn-on frequencies in a predetermined second duration for each of a plurality of predetermined second durations starting at different start times, in a predetermined period. The predetermined second duration is, for example, six hours to 12 hours. When the printer is left for the predetermined second duration or more without printing after the last cleaning operation, discharge failures can occur in the first nozzles 41 and the second nozzles 42 of the ink heads 40A, 40B, and 40C. In view of this, in a case where the predetermined second duration has elapsed from the last cleaning operation, there is a possibility of occurrence of a discharge failure in the first nozzles 41 and the second nozzles 42. Thus, a cleaning operation is preferably performed in order to obtain discharge stability. The predetermined second duration is appropriately determined depending on the type of ink to be used, for example.

In the example shown in FIG. 7, the predetermined second duration is 8 hours, the sum of turn-on frequencies in a second duration P0 (from 0 o'clock to 8 o'clock) starting at 0 o'clock is two, the sum of turn-on frequencies in a second duration P1 (from 1 o'clock to 9 o'clock) starting at 1 o'clock is 22, the sum of turn-on frequencies in a second duration P2 (from 2 o'clock to 10 o'clock) starting at 2 o'clock is 30, the sum of turn-on frequencies in a second duration P3 (from 3 o'clock to 11 o'clock) starting at 3 o'clock is 32, the sum of turn-on frequencies in a second duration P4 (from 4 o'clock to 12 o'clock) starting at 4 o'clock is 33, the sum of turn-on frequencies in a second duration P5 (from 5 o'clock to 13 o'clock) starting at 5 o'clock is 33, the sum of turn-on frequencies in a second duration P6 (from 6 o'clock to 14 o'clock) starting at 6 o'clock is 48, the sum of turn-on frequencies in a second duration P7 (from 7 o'clock to 15 o'clock) starting at 7 o'clock is 50, the sum of turn-on frequencies in a second duration P8 (from 8 o'clock to 16 o'clock) starting at 8 o'clock is 49, and the sum of turn-on frequencies in a second duration P9 (from 9 o'clock to 17 o'clock) starting at 9 o'clock is 30.

The specifier 75 specifies, as a specified start time, a start time of a predetermined second duration for which the sum calculated by the calculator 73 is at maximum. In the example shown in FIG. 7, the sum of turn-on frequencies in the second period P7 starting at 7 o'clock is at maximum (50 times in this example), and thus, the specifier 75 specifies 7 o'clock as the specified start time.

The cleaner 77 performs the cleaning operation at the specified start time specified by the specifier 75. The cleaning operation discharges ink from at least the ink heads 40A, 40B, and 40C. The cleaning operation includes at least the suction operation described above. In this preferred embodiment, the cleaning operation includes the suction operation and the wiping operation described above. In the example shown in FIG. 7, the cleaner 77 performs the cleaning operation at 7 o'clock.

The print controller 79 controls printing of a predetermined image on a recording medium 5. The print controller 79 controls the head mover 31, the medium transport mechanism 32, and the ink heads 40A, 40B, and 40C based on image data stored in the memory 71. The memory 71, the calculator 73, the specifier 75, and the cleaner 77 can also function in a case where the sub-power supply switch 12C is off or in the case of the sleep state. On the other hand, the print controller 79 does not function in the case where the sub-power supply switch 12C is off or in the case of the sleep state. The print controller 79 functions by turning the sub-power supply switch 12C on or by canceling the sleep state.

As described above, in the printer 10 according to this preferred embodiment, the calculator 73 calculates a sum of turn-on frequencies of the sub-power supply switch 12C for each of predetermined second durations starting at different start times. The specifier 75 specifies, as the specified start time, the start time of the predetermined second duration for which the sum of turn-on frequencies is at maximum. In a case where the predetermined second duration or more, for example, has elapsed from the previous cleaning operation after turning off of the sub-power supply switch 12C, the cleaning operation needs to be performed before printing. The specifier 75 can specify the most efficient timing for performing the cleaning operation. The cleaner 77 performs the cleaning operation at the specified start time specified by the specifier 75. Accordingly, the cleaning operation has been already completed before the user turns the sub-power supply switch 12C on, and the possibility of perforing no cleaning operation after turning on of the sub-power supply switch 12C and before start of printing is the highest. That is, the cleaning operation is completed prior to a time zone in which the possibility of turning on of the sub-power supply switch 12C is high. Accordingly, the cleaning operation is likely to have been already performed when the user starts printing by turning the sub-power supply switch 12C on, and thus, interruption of work by the user is reduced.

In the printer 10 according to this preferred embodiment, the cleaning operation includes the suction operation in which fluid in the hermetic space 48 is sucked by the suction pump 83 so that ink is discharged from the first nozzles 41 and the second nozzles 42 of the ink heads 40A, 40B, and 40C. As described above, in a case where there the possibility that the first nozzles 41 and the second nozzles 42 are clogged at a relatively high degree is high, the suction operation with which the amount of ink discharge from the first nozzles 41 and the second nozzles 42 is relatively large is performed to enable the first nozzles 41 and the second nozzles 42 with discharge failures to restore as intended.

In the printer 10 according to this preferred embodiment, the cleaning operation includes the wiping operation of wiping the nozzle surfaces 43 of the ink heads 40A, 40B, and 40C with the wiper 51 after the suction operation has been performed. Accordingly, ink is able to be removed from the nozzle surfaces 43 to suppress or prevent solidification of ink on the nozzle surfaces 43. At the same time, meniscuses of the plurality of first nozzles 41 and second nozzles 42 can be in an appropriate state.

The foregoing description is directed to the preferred embodiments of the present invention. The preferred embodiments described above, however, are merely examples, and the present disclosure can be performed in various modes.

Figure 8:
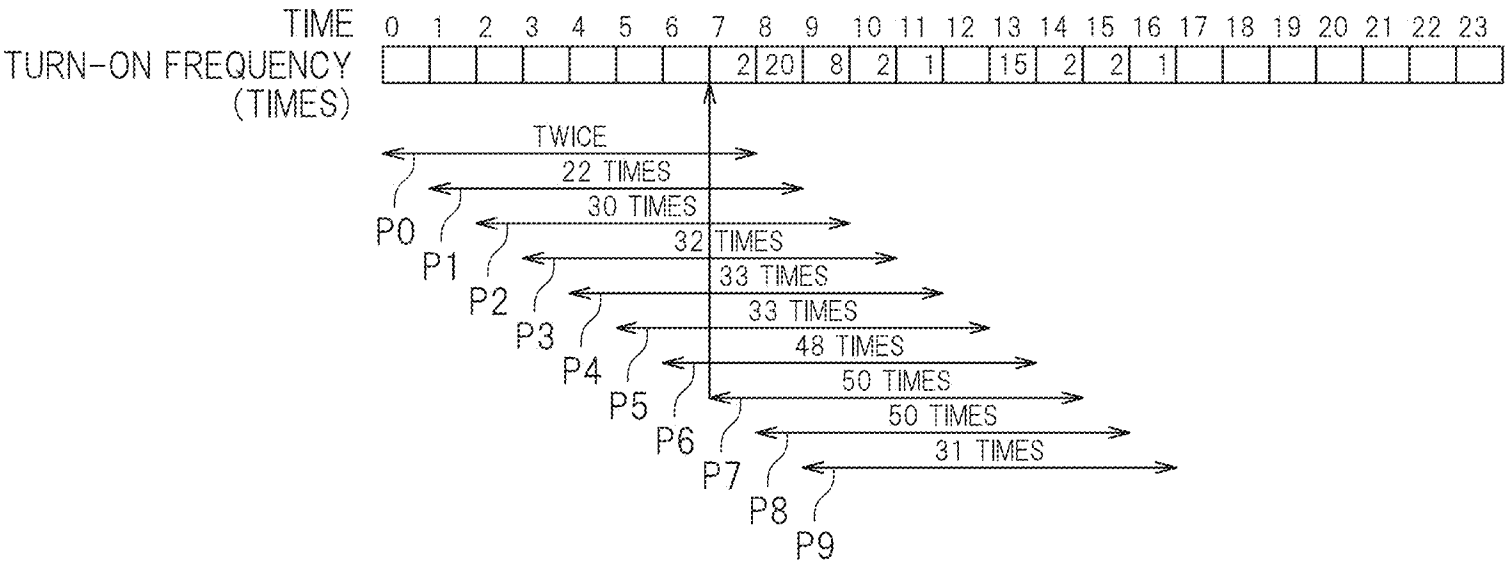
FIG. 8 is another example of the graph showing the frequency of turning on of the sub-power supply switch per a unit time.

In a case where there are a plurality of predetermined second durations for which the sum calculated by the calculator 73 is at maximum, the specifier 75 may specify, as the specified start time, the start time of the predetermined second duration starting at the earliest start time among the plurality of predetermined second durations. The example shown in FIG. 8 is the same as the example shown in FIG. 7 except that the turn-on frequency of the sub-power supply switch 12C is twice from 15 o'clock to 16 o'clock. In the example shown in FIG. 8, the sum of turn-on frequencies in the second duration P7 (from 7 o'clock to 15 o'clock) starting at 7 o'clock and the sum of turn-on frequencies in the second duration P8 (from 8 o'clock to 16 o'clock) starting at 8 o'clock are both 50. In this case, the start time of the second duration P7 starting at 7 o'clock is the earliest, and thus, the specifier 75 specifies 7 o'clock as the specified start time. As described above, by specifying the earliest start time of the predetermined second duration as the specified start time, in a case where printing is performed consecutively, no cleaning operation needs to be performed after printing in some cases. Accordingly, interruption of work by the user can be further reduced.

Figure 9:
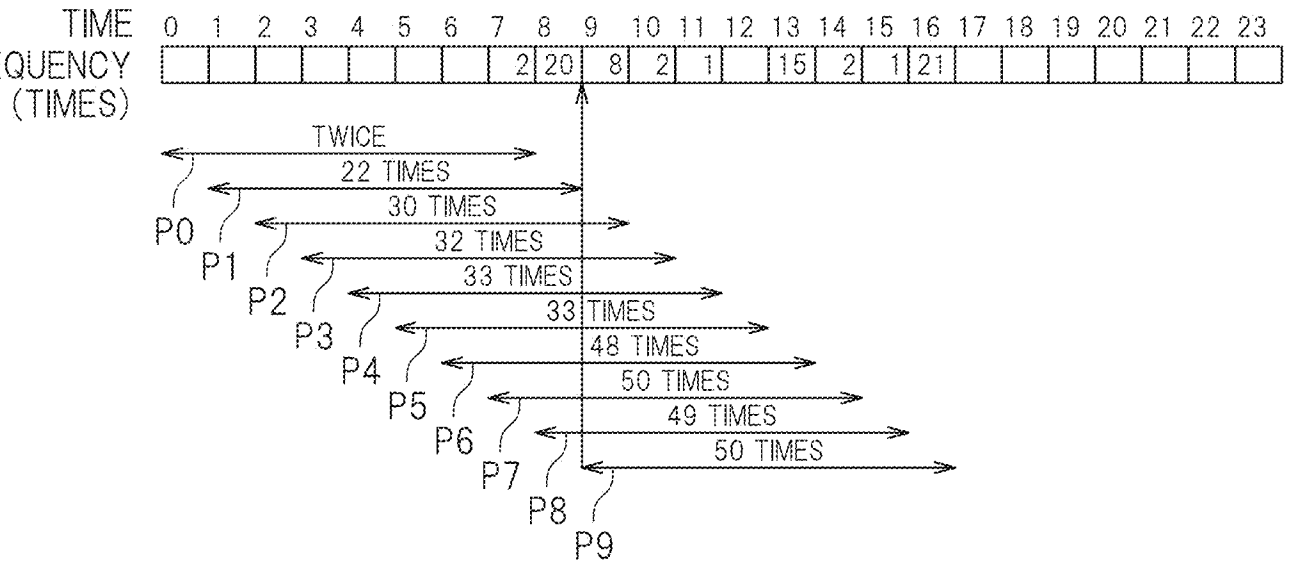
FIG. 9 is yet another example of the graph showing the frequency of turning on of the sub-power supply switch per a unit time.

In the case where there are a plurality of predetermined second durations for which the sum calculated by the calculator 73 is at maximum, the specifier 75 may specify, as the specified start time, the start time of the predetermined second duration including the maximum value of turn-on frequencies among the plurality of predetermined second durations. The example shown in FIG. 9 is the same as the example shown in FIG. 7 except that the turn-on frequency of the sub-power supply switch 12C is 21 from 16 o'clock to 17 o'clock. In the example shown in FIG. 9, the sum of turn-on frequencies in the second duration P7 (from 7 o'clock to 15 o'clock) starting at 7 o'clock and the sum of turn-on frequencies in the second duration P9 (from 9 o'clock to 17 o'clock) starting at 9 o'clock are both 50. In this case, the maximum value of turn-on frequency of the sub-power supply switch 12C is 21 from 16 o'clock to 17 o'clock. Thus, the specifier 75 specifies 9 o'clock as the specified start time. Accordingly, when the user turns the sub-power supply switch 12C on for starting printing, the cleaning operation is more likely to have been performed, and thus, interruption of work by the user can be reduced.

The cleaner 77 may be configured not to perform the cleaning operation at the specified start time in a case where the sub-power supply switch 12C is turned on before the specified start time and a duration from turn-on of the sub-power supply switch 12C to the specified start time is shorter than the predetermined second duration. In a case where the user turns the sub-power supply switch 12C on before the specified start time, the cleaning operation is performed at turning on of the sub-power supply switch 12C. Thus, when printing continues after the cleaning operation, the cleaning operation does not need to be performed again. Accordingly, interruption of work by the user can be further reduced. For example, in the example shown in FIG. 7, although the specified start time is 7 o'clock, when the user turns the sub-power supply switch 12C on at 6 o'clock, since the predetermined second duration or more has elapsed after the previous cleaning operation, the cleaning operation is performed. Thereafter, since the cleaning operation has been already performed at 7 o'clock, the cleaner 77 does not perform the cleaning operation at 7 o'clock that is the specified start time.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

an ink head including a plurality of nozzles from which ink is discharged onto a recording medium and a nozzle surface in which the plurality of nozzles are provided;

a controller that controls discharge of ink from the plurality of nozzles;

a main power supply that drives the controller; and a sub-power supply that enables printing on the recording medium by the ink head; wherein the controller includes:

a memory that stores a turn-on frequency of turning on of the sub-power supply per a unit time in a predetermined period of a predetermined first duration;

a calculator that calculates a sum of the turn-on frequency in a predetermined second duration for each of a plurality of predetermined second durations starting at different start times in the predetermined period;

a specifier that specifies, as a specified start time, a start time of the predetermined second duration for which the sum calculated by the calculator is at maximum; and a cleaner that performs a cleaning operation of discharging ink from at least the plurality of nozzles at the specified start time specified by the specifier.

2. The ink jet printer according to claim 1, wherein in a case where there are a plurality of predetermined second durations for which the sum calculated by the calculator is at a maximum, the specifier specifies, as the specified start time, the start time of the predetermined second duration starting at the earliest start time among the plurality of predetermined second durations.

3. The ink jet printer according to claim 1, wherein in a case where there are a plurality of predetermined second durations for which the sum calculated by the calculator is at a maximum, the specifier specifies, as the specified start time, the start time of the predetermined second duration including a maximum value of the turn-on frequency among the plurality of predetermined second durations.

4. The ink jet printer according to claim 1, wherein in the predetermined period, in a case where the sub-power supply is turned on before the specified start time and a period from turning on of the sub-power supply to the specified start time is shorter than the predetermined second duration, the cleaner does not perform the cleaning operation at the specified start time.

5. The ink jet printer according to claim 1, further comprising:

a cap detachably attached to the ink head such that while the cap is attached to the ink head, the cap covers the nozzle surface and defines a hermetic space with the nozzle surface; and a suction pump that is controlled by the controller and sucks fluid remaining in the hermetic space; wherein the cleaning operation includes a suction operation of sucking fluid remaining in the hermetic space by the suction pump and discharging ink from the plurality of nozzles.

6. The ink jet printer according to claim 5, further comprising a wiper that is controlled by the controller and wipes the nozzle surface; wherein the cleaning operation includes a wiping operation of wiping the nozzle surface by the wiper after the suction operation.

* * * * *